US010409216B2

(12) United States Patent
Chueh

(10) Patent No.: US 10,409,216 B2
(45) Date of Patent: Sep. 10, 2019

(54) PRINTER MODULE HAVING PRINT-HEAD MOVING MECHANISM

(71) Applicant: AVISION INC., Hsinchu (TW)

(72) Inventor: Chuang-Hua Chueh, Hsin Chu (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 15/934,524

(22) Filed: Mar. 23, 2018

(65) Prior Publication Data

US 2018/0321636 A1 Nov. 8, 2018

(30) Foreign Application Priority Data

May 5, 2017 (TW) ..... 106114907 A

(51) Int. Cl.

| | |
|---|---|
| ***G03G 21/18*** | (2006.01) |
| ***G03G 15/04*** | (2006.01) |
| ***G03G 21/16*** | (2006.01) |
| ***B41J 29/56*** | (2006.01) |
| ***B41J 29/02*** | (2006.01) |

(52) U.S. Cl.

CPC ..... *G03G 21/1842* (2013.01); *B41J 29/02* (2013.01); *B41J 29/56* (2013.01); *G03G 15/04* (2013.01); *G03G 21/1619* (2013.01); *G03G 21/1647* (2013.01)

(58) Field of Classification Search

CPC ..... G03G 15/0435; G03G 15/04; G03G 21/1647; G03G 21/1842; B41J 29/56

See application file for complete search history.

(56) References Cited

U.S. PATENT DOCUMENTS

| | | | | |
|---|---|---|---|---|
| 9,008,547 | B2 | 4/2015 | Takano | |
| 9,429,906 | B2 | 8/2016 | Yoshimura et al. | |
| 9,482,983 | B1 * | 11/2016 | Kono | G03G 15/04 |
| 9,836,020 | B2 | 12/2017 | Yoshimura et al. | |
| 2013/0308983 | A1 | 11/2013 | Takano | |
| 2014/0212170 | A1 | 7/2014 | Kato et al. | |
| 2015/0227110 | A1 | 8/2015 | Yoshimura et al. | |

(Continued)

FOREIGN PATENT DOCUMENTS

| | | | |
|---|---|---|---|
| CN | 106168746 | A | 11/2016 |
| TW | 201610620 | A | 3/2016 |

*Primary Examiner* — Clayton E. LaBalle
*Assistant Examiner* — Jessica L Eley
(74) *Attorney, Agent, or Firm* — Muncy, Geissler, Olds & Lowe, P.C.

(57) ABSTRACT

A printer module includes a frame body, a drum, a print head and a print-head moving mechanism. The drum is detachably connected to the frame body. The print-head moving mechanism movably connected to the frame body moves the print head in a horizontal direction substantially perpendicular to a direction of gravity exerted on the print-head moving mechanism. The print-head moving mechanism includes: a shaft rotatably connected to the frame body; an actuating rod connected to the shaft and rotated to rotate the shaft; and an actuating member connected to shaft and rotated with rotation of the shaft, so that the print head is moved between a first position and a second position. Thus, the volume occupied by the printer module can be reduced, the user's operation can be simplified, the influence and interference of the gravity can further be eliminated to simplify the design of the print-head moving mechanism.

12 Claims, 8 Drawing Sheets

(56) References Cited

U.S. PATENT DOCUMENTS

| | | | |
|---|---|---|---|
| 2016/0018779 | A1 | 1/2016 | Takano |
| 2016/0342106 | A1 | 11/2016 | Kono |
| 2017/0010580 | A1 | 1/2017 | Yoshimura et al. |
| 2018/0067452 | A1 | 3/2018 | Yoshimura et al. |

* cited by examiner

PRINTER MODULE HAVING PRINT-HEAD MOVING MECHANISM

CROSS-REFERENCE TO RELATED APPLICATIONS

This application claims priority of No. 106114907 filed in Taiwan R.O.C. on May 5, 2017 under 35 USC 119, the entire content of which is hereby incorporated by reference.

BACKGROUND OF THE INVENTION

Field of the Invention

This disclosure relates to a printer module, and more particularly to a printer module having a print-head moving mechanism.

Description of the Related Art

A conventional machine, such as a printer, a copier or a multi-function peripheral, having a printer module usually has an optical write head to form a latent image on a drum to perform the printing operation. The printer module having light emitting diodes arranged in an array needs to be close to the drum so that the operation can be performed. The drum and a development roller are usually installed in one processing cartridge, which can be taken out by a user or maintenance man to perform the maintenance or toner refilling.

In the conventional maintenance state, the user lifts up an upper cover, and moves the optical write head upward and away from the drum through a linking-up mechanism, and then takes out the processing cartridge in the direction perpendicular to an axial direction. Usually, the operation needs to be executed through the complicated link mechanism. In addition, under the control of the link mechanism, the optical write head is moved in the vertical direction and further rotated. The mechanism is disclosed in, for example, U.S. Pat. No. 9,008,547, wherein a relatively large space needs to be reserved in the copier so that the optical write head can be moved and rotated, and this is disadvantageous to the miniaturized requirement. In addition, U.S. Pat. No. 9,008,547 adopts the up-lifting upper cover having a top surface serving as a tray for print media. Thus, when maintenance is needed in the copy process, the media on the tray need to be removed, and then placed back after the maintenance, thereby causing inconvenience in use.

BRIEF SUMMARY OF THE INVENTION

An object of this disclosure is to provide a printer module having a print-head moving mechanism, which moves a print head in a horizontal direction to reduce the influence and interference caused by the gravity.

Another object of this disclosure is to provide a printer module having a print-head moving mechanism, wherein an actuating member on a rotating shaft is utilized to move the print head to effective simplify the print-head moving mechanism and satisfy the maintenance requirement of the printer module at the same time.

To achieve the above-identified object, this disclosure provides a printer module, which includes: a frame body; a drum detachably connected to the frame body; a print head movably connected to the frame body; and a print-head moving mechanism, which is movably connected to the frame body, and moves the print head in a horizontal direction substantially perpendicular to a direction of gravity exerted on the print-head moving mechanism.

This disclosure further provides a printer module, which includes: a frame body; a drum, detachably connected to the frame body; a print head, movably connected to the frame body; and a print-head moving mechanism, which is movably connected to the frame body to move the print head. The print-head moving mechanism includes: a shaft, rotatably connected to the frame body; an actuating rod, connected to the shaft and rotated to rotate the shaft; and an actuating member, connected to the shaft and rotated with rotation of the shaft, so that the print head is moved between a first position and a second position.

With the above-mentioned embodiment, the volume occupied by the printer module is quite small, the up-lifting type upper cover is no longer needed, and there is also unnecessary to move the print head in a substantially vertical direction. Therefore, it is considerably helpful to the reduction of the volume and simplification of the user's operation. Furthermore, because the movement direction of the print head is substantially horizontal, the influence of gravity can be eliminated, and the design of the print-head moving mechanism can be simplified. Meanwhile, the good positioning effect is provided.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

An embodiment of this disclosure provides a printer module which can be used in printers, copiers, multi-function peripherals and so on. The printer module has a proximity-type print head, such as a light-emitting diode print head (referred to as LPH). Therefore, the print head needs to be close to the drum upon printing, and needs to be kept away from the drum during maintenance so as to avoid damage caused by the collision with the drum.

Figure 1:
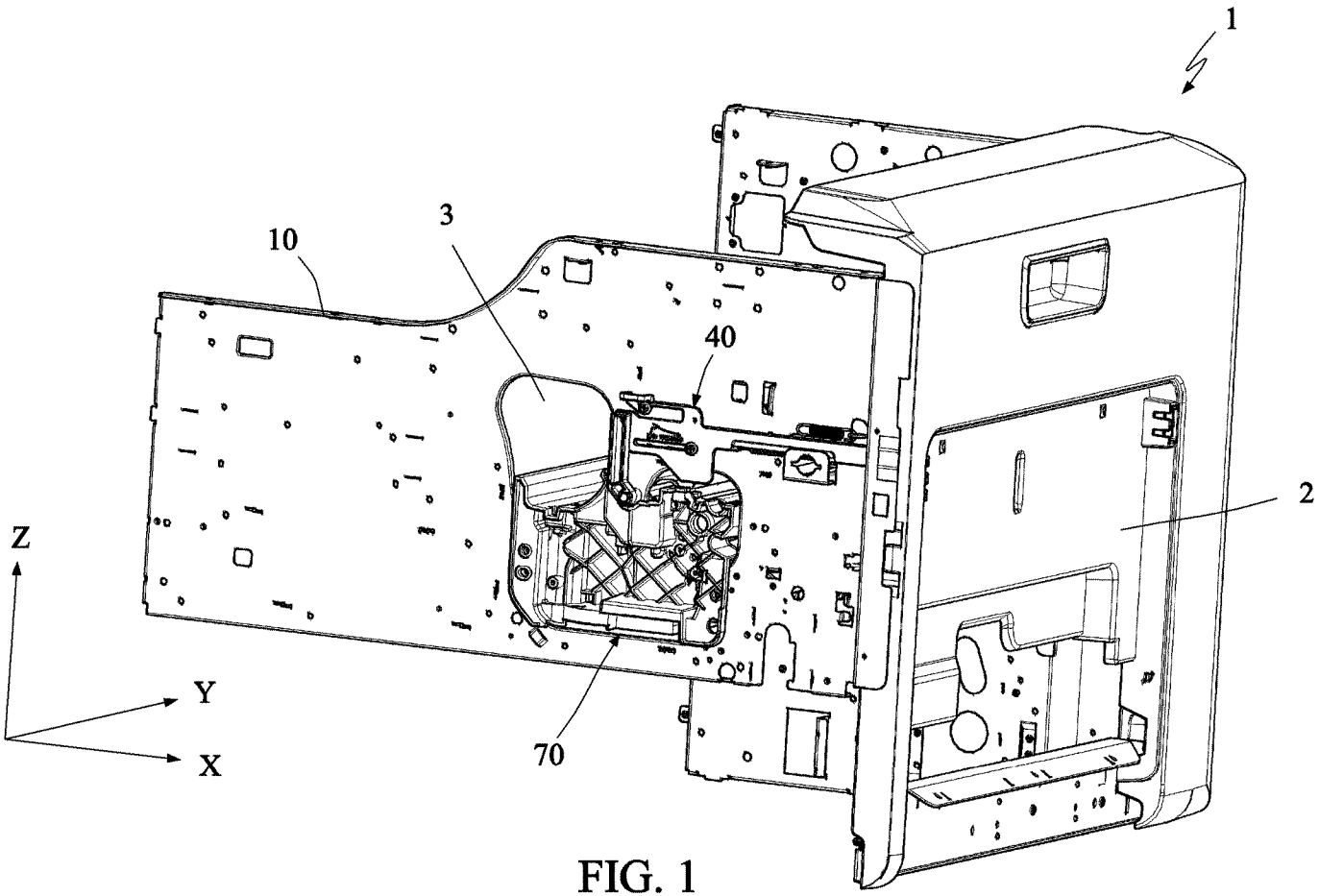
FIG. 1 is a partial pictorial view showing a printer module according to a preferred embodiment of this disclosure.
Figure 2:
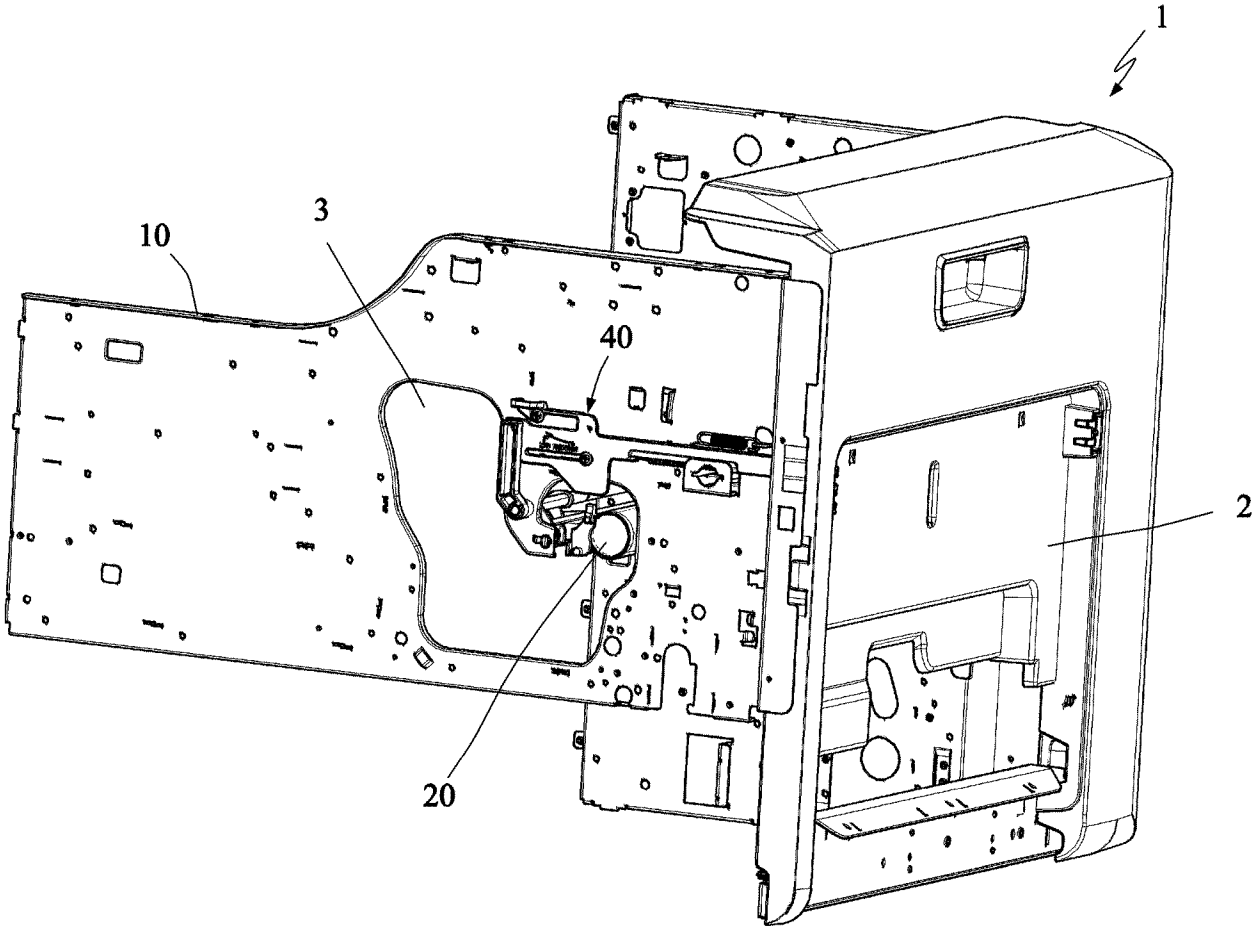
FIG. 2 is a partial pictorial view showing the printer module of FIG. 1 with a processing cartridge being removed.
Figure 3:
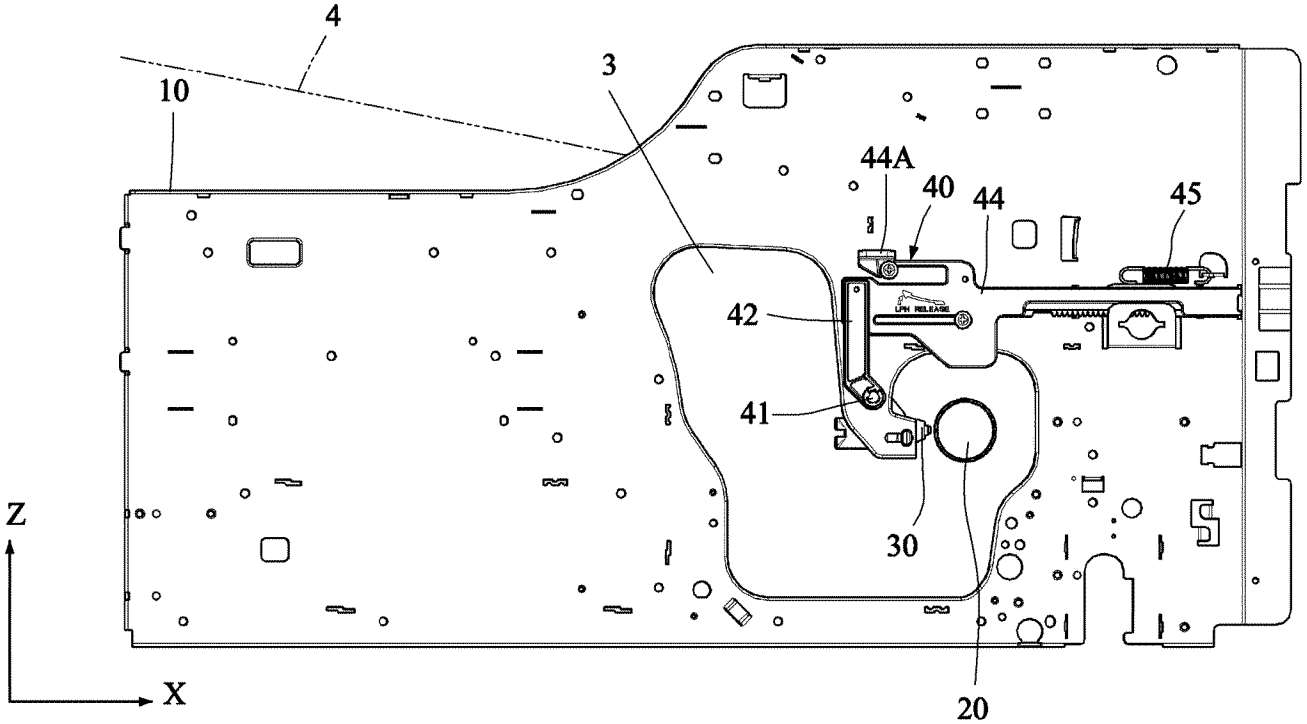
FIG. 3 is a partial front view showing the printer module of FIG. 2.
Figure 4:
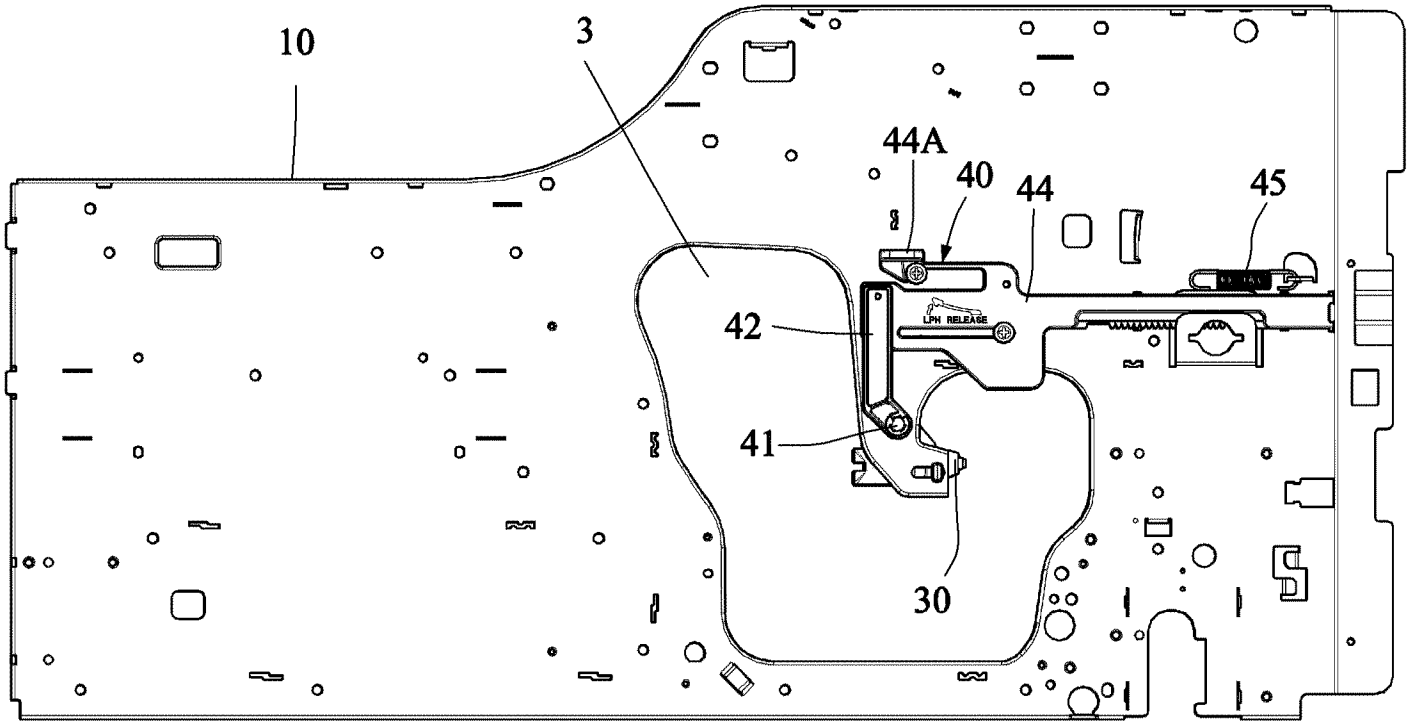
FIG. 4 is a partial front view showing the printer module of FIG. 3 with a drum being removed.

FIG. 1 is a partial pictorial view showing a printer module 1 according to the preferred embodiment of this disclosure. FIG. 2 is a partial pictorial view showing the printer module 1 of FIG. 1 with a processing cartridge being removed. FIG. 3 is a partial front view showing the printer module 1 of FIG. 2. FIG. 4 is a partial front view showing the printer module 1 of FIG. 3 with a drum being removed. Referring to FIGS. 1 to 4, the printer module 1 includes a frame body 10, a drum 20, a print head 30 and a print-head moving mechanism 40.

The printer module 1 may be a part of a printer or multi-function peripheral. The side surface of the printer module 1 has a cavity 2, a cover 60 (not shown in FIG. 1, but shown in FIG. 6) is rotatably disposed on the side surface of the printer module 1 to close the cavity 2. The cover 60 is closed when the printing is performed. The cover 60 is opened when the maintenance is performed. The printer module 1 may further have a processing cartridge 70. The processing cartridge 70 may be installed into a receiving slot 3 of the frame body 10 in the positive Y-axis direction, and may be removed away from the receiving slot 3 in the negative Y-axis direction, so that the maintenance work of supplementing or refilling toners can be facilitated, for example. That is, the disassembling or detaching direction of the drum 20 relative to the frame body 10 is an axial direction of the drum 20, and the axial direction is substantially perpendicular to the X-axis direction, and is substantially parallel to the Y-axis direction.

In response to the movement of the processing cartridge 70, the print-head moving mechanism 40 of the printer module 1 needs to move the print head 30 in the positive and negative X-axis directions to prevent the print head 30 from colliding with the processing cartridge 70.

The processing cartridge 70 is detachably connected to the frame body 10. Because the drum 20 is a part of the processing cartridge 70, the drum 20 is also detachably connected to the frame body 10.

The print head 30 is movably connected to the frame body 10. In this embodiment, the print head 30 is movable in the positive and negative X directions as well as the positive and negative Y directions. The movement range of the print head 30 in the positive and negative Y directions can be defined by the processing cartridge 70 and the frame body 10. That is, the processing cartridge 70 and the frame body 10 commonly position the print head 30 in the Y direction.

The print-head moving mechanism 40 is movably connected to the frame body 10 and moves the print head 30 in a horizontal direction (X-axis direction), and the horizontal direction is substantially perpendicular to a direction of gravity (Z-axis direction) exerted on the print-head moving mechanism 40. In this embodiment, the print head 30 before being moved from a first position P1 closest to the drum 20 (see also FIG. 5) and the print head 30 after being moved to a second position P2 further from the drum 20 (see also FIG. 6) are directed to or directed in the same direction, such as the horizontal direction, with no change in a perpendicular direction, and are disposed at the same horizontal level. In other words, the light emitting direction from the print head 30 to the drum 20 is kept unchanged before and after the print head 30 is moved. With such the design of restricting the movement direction and directing (or facing) direction of the print head 30, the influence caused by the tolerance and errors in designing and manufacturing the print head 30 can be reduced, and the print head 30 is ensured to be always in alignment with the drum 20.

The printer module 1 may further have a medium tray 4, which is connected to the frame body 10 and carries or supports the printed media. A medium supply tray (not shown) may be disposed below the medium tray 4.

It is worth noting that the drum 20 in FIGS. 2 and 3 should have been removed to present the state in FIG. 4. Therefore, the drum 20 in FIGS. 2 and 3 is only displayed for reference of the relative position.

Figure 5:
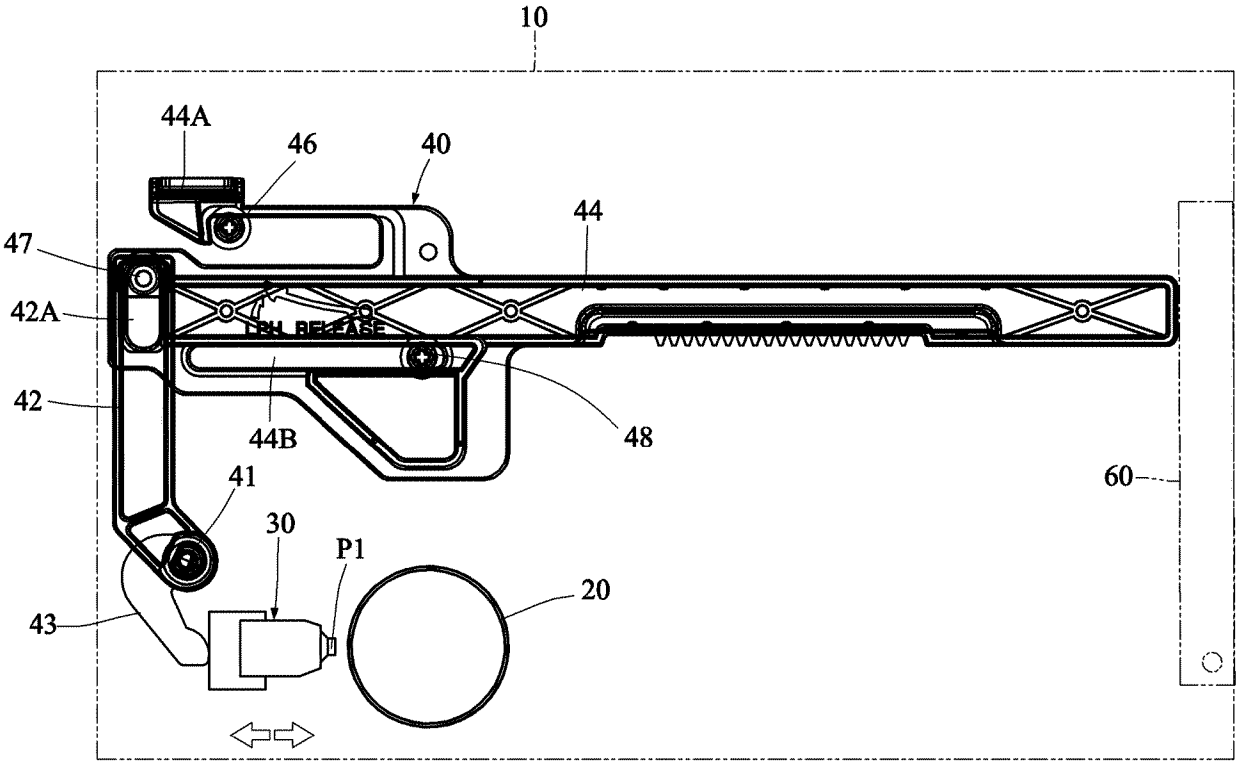
FIGS. 5 and 6 are partial front views showing the printer module of FIG. 4, wherein the print heads are respectively disposed at a first position and a second position.
Figure 6:
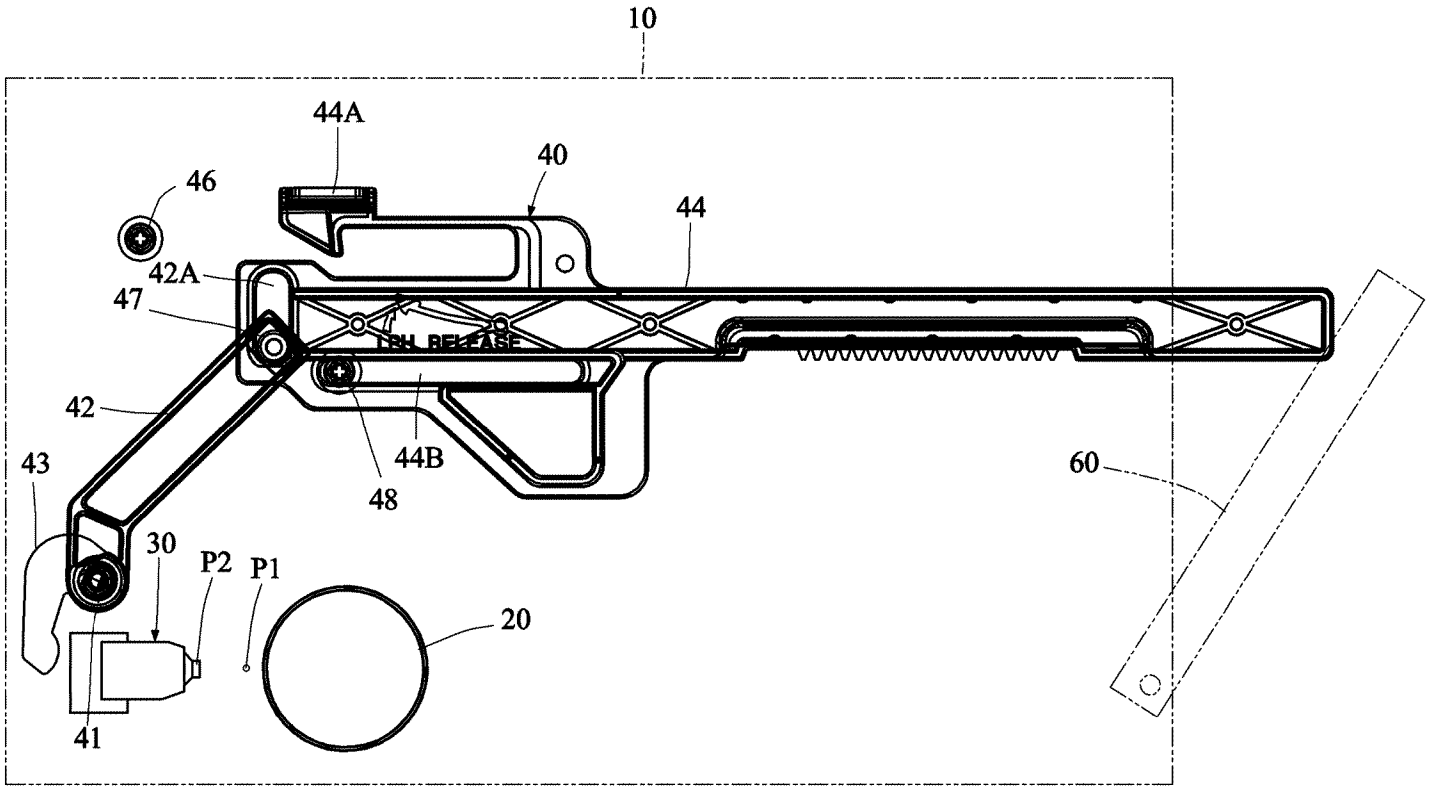

FIGS. 5 and 6 are partial front views showing the printer module 1 of FIG. 4, wherein the print heads 30 are respectively disposed at the first position P1 and the second position P2. As shown in FIGS. 3 to 6, the print-head moving mechanism 40 includes a shaft 41, an actuating rod 42 and an actuating member 43. As shown in FIGS. 5 and 6, the slider 44 is moved in a direction opposite to a direction, in which the print head 30 is moved.

The shaft 41 is rotatably connected to the frame body 10. The actuating rod 42 is connected to the shaft 41, and is rotated to rotate the shaft 41. The actuating rod 42 has a long slot 42A. The actuating member 43 is connected to the shaft 41, and rotated with rotation of the shaft 41, so that the print head 30 is moved between the first position P1 and the second position P2, wherein the first position P1 is closer to the drum 20 than the second position P2. That is, the user rotates the actuating rod 42 to rotate the shaft 41 and the actuating member 43, and the actuating member 43 is in sliding contact with the print head 30, so that the print head 30 is controlled to move in only the positive and negative X directions and positioned at the first position P1 and the second position P2, respectively.

In addition, the print-head moving mechanism 40 may further include a slider 44, which is movably connected to the frame body 10, connected to the actuating rod 42 and has a resilient locking structure 44A capable of resiliently locking with the frame body 10 and unlocking from the frame body 10. The resilient locking structure 44A is hooked onto a positioning pin 46 disposed on the frame body 10. The slider 44 also has a sliding slot 44B, and the sliding slot 44B is guided by a guide pin 48 so that the slider 44 can slide along a straight line. The guide pin 48 is also disposed on the frame body 10. A combination pin 47 combines the slider 44 with the actuating rod 42, and is movable along the long slot 42A of the actuating rod 42.

In FIGS. 5 and 6, the cover 60 is rotatably connected to the frame body 10. When the cover 60 is rotated to a closed position relatively to the frame body 10 (see FIG. 5), the cover 60 pushes the print-head moving mechanism 40 to a position to lock with the frame body 10. That is, the cover 60 pushes the slider 44 to a position where the slider 44 locks with the frame body 10.

Figure 7:
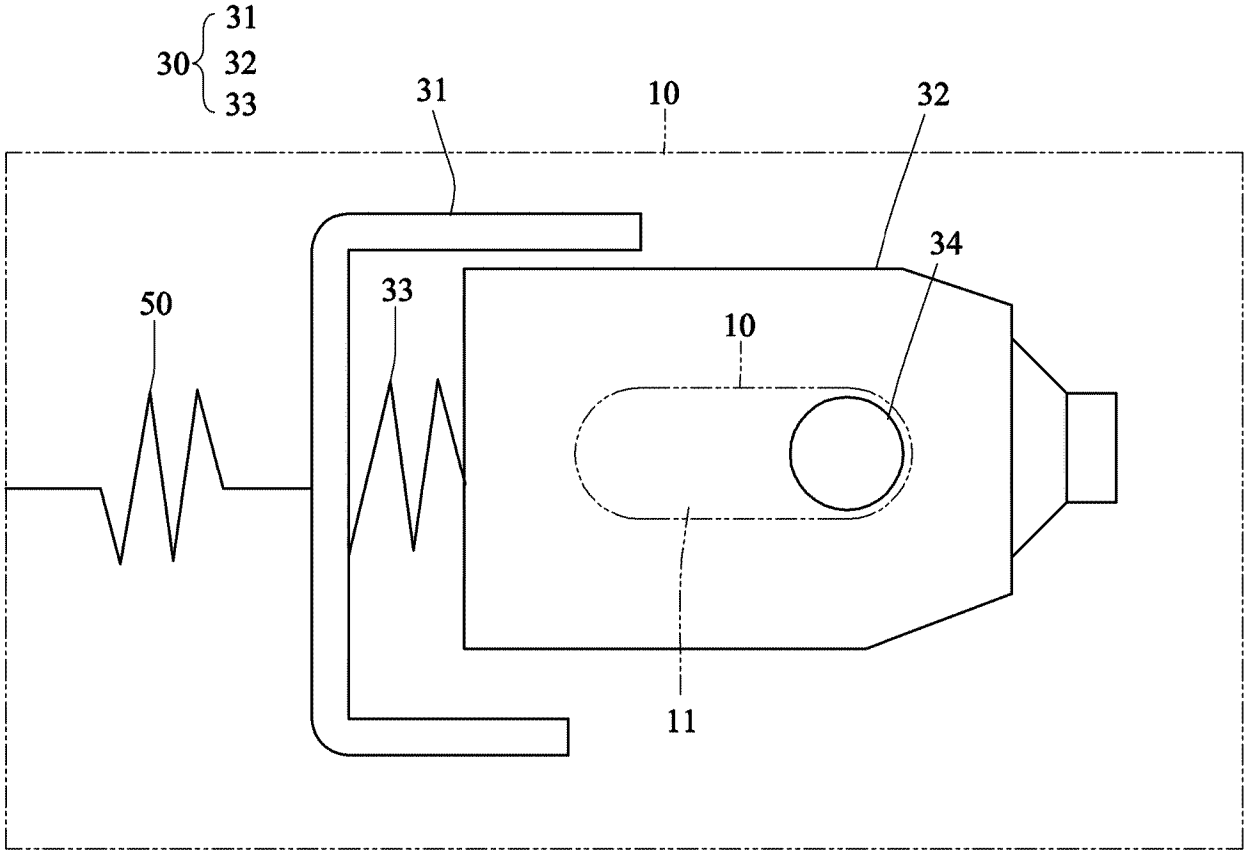
FIG. 7 shows an example of the print head.

FIG. 7 shows an example of the print head. As shown in FIGS. 7, 6 and 5, the printer module 1 further includes an elastic member 50 connected to the frame body 10 and the print head 30. The elastic member 50 receives a force of the print-head moving mechanism 40 to save energy, and then releases the energy to push the print head 30 to the second position P2. The print head 30 has a base seat 31, a head 32 and a spring 33. The head 32 is formed with a projection 34 which may slide in a sliding slot 11 of the frame body 10. The spring 33 connects the base seat 31 to the head 32 to provide the head 32 with the ability of linear elastic movement.

Figure 8:
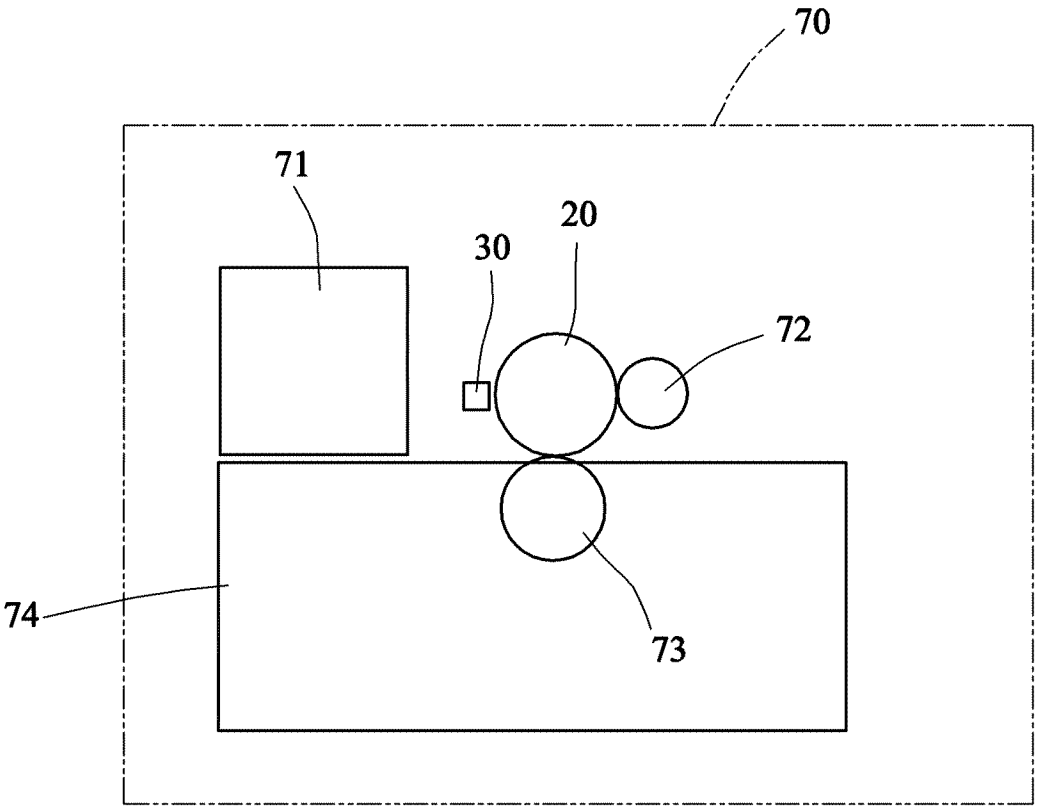
FIG. 8 is a schematic view showing the processing cartridge.

FIG. 8 is a schematic view showing the processing cartridge 70. As shown in FIG. 8, the drum 20 is a part of the processing cartridge 70. The processing cartridge 70 further includes a toner cartridge 71, a transfer roller 72 and a development roller 73, all which are connected to the drum 20. The toner cartridge 71 supplies the toner to a developing cartridge 74, the development roller 73 in the developing cartridge 74 makes the toner be attached to the drum 20, and the transfer roller 72 transfers the toner on the drum 20 to a medium or a sheet of paper to complete the front stage work of printing.

Although the above-mentioned embodiment of this disclosure provides a print head that can be moved in the horizontal direction, the print-head moving mechanism 40 of this disclosure is also applied to a print head that can be moved in a non-horizontal direction. With the arrangements of the shaft 41, the actuating rod 42 and the actuating member 43, the effect of this disclosure can be achieved as long as the print head 30 can be moved between the first position P1 and the second position P2.

With the above-mentioned embodiment, the volume occupied by the printer module is quite small, the up-lifting type upper cover is no longer needed, and there is also no need to move the print head in a substantially vertical direction. Therefore, it is considerably helpful to the reduction of the volume and simplification of the user's operation. Furthermore, because the movement direction of the print head is substantially horizontal, the influence of gravity can be eliminated, and the design of the print-head moving mechanism can be simplified. Meanwhile, the good positioning effect is provided.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. A printer module, comprising:
- a frame body;
- a drum detachably connected to the frame body;
- a print head movably connected to the frame body; and
- a print-head moving mechanism, which is movably connected to the frame body, and moves the print head in a horizontal direction perpendicular to a direction of gravity exerted on the print-head moving mechanism, wherein the print head before being moved from a first position closest to the drum and the print head after being moved to a second position further from the drum are directed in the same horizontal direction with no change in a perpendicular direction and are disposed at the same horizontal level.

2. The printer module according to claim 1, wherein the print-head moving mechanism comprises:
- a shaft rotatably connected to the frame body;
- an actuating rod connected to the shaft and rotated to rotate the shaft; and
- an actuating member, which is connected to the shaft and rotated with rotation of the shaft, so that the print head is moved between the first position and the second position.

3. The printer module according to claim 2, wherein the print-head moving mechanism further comprises a slider, which is movably connected to the frame body, connected to the actuating rod, and has a resilient locking structure capable of resiliently locking with the frame body and unlocking from the frame body.

4. The printer module according to claim 3, further comprising a cover rotatably connected to the frame body, when the cover is rotated to a closed position relatively to the frame body, the cover pushes the slider to a position where the slider locks with the frame body.

5. The printer module according to claim 3, wherein the slider is moved in a direction opposite to a direction, in which the print head is moved.

6. The printer module according to claim 2, further comprising an elastic member, connecting the frame body to the print head, wherein the elastic member receives a force of the print-head moving mechanism to save energy, and then releases the energy to push the print head to the second position.

7. The printer module according to claim 1, further comprising a cover rotatably connected to the frame body, wherein when the cover is rotated to a closed position relatively to the frame body, the cover pushes the print-head moving mechanism to a position where the slider locks with the frame body.

8. The printer module according to claim 1, wherein a disassembling direction of disassembling the drum from the frame body is an axial direction of the drum substantially perpendicular to the horizontal direction.

9. The printer module according to claim 1, wherein the drum is a part of a processing cartridge, and the processing cartridge further comprises a toner cartridge, a transfer roller and a development roller connected to the drum.

10. A printer module, comprising:
- a frame body;
- a drum detachably connected to the frame body;
- a print head movably connected to the frame body; and
- a print-head moving mechanism, which is movably connected to the frame body to move the print head, the print-head moving mechanism comprising:
  - a shaft rotatably connected to the frame body;
  - an actuating rod connected to the shaft and rotated to rotate the shaft; and
  - an actuating member connected to the shaft and rotated with rotation of the shaft, so that the print head is moved between a first position and a second position, wherein the print head before being moved from the first position closest to the drum and the print head after being moved to the second position further from the drum are directed in the same horizontal direction with no change in a perpendicular direction and are disposed at the same horizontal level.

11. The printer module according to claim 10, wherein the print-head moving mechanism further comprises a slider movably connected to the frame body and connected to the actuating rod, wherein the slider has a resilient locking structure capable of resiliently locking with the frame body and unlocking from the frame body.

12. The printer module according to claim 11, wherein the slider is moved in a direction opposite to a direction, in which the print head is moved.

* * * * *